US008231328B2

(12) United States Patent
Reed

(10) Patent No.: US 8,231,328 B2
(45) Date of Patent: Jul. 31, 2012

(54) FAN CASING FOR A GAS TURBINE ENGINE

(75) Inventor: Julian M. Reed, Derby (GB)

(73) Assignee: Rolls-Royce PLC, London (GB)

( * ) Notice: Subject to any disclaimer, the term of this patent is extended or adjusted under 35 U.S.C. 154(b) by 496 days.

(21) Appl. No.: 12/457,691

(22) Filed: Jun. 18, 2009

(65) Prior Publication Data

US 2010/0028129 A1 Feb. 4, 2010

(30) Foreign Application Priority Data

Jul. 29, 2008 (GB) ..... 0813820.8

(51) Int. Cl.
*F01D 25/24* (2006.01)

(52) U.S. Cl. ..... 415/9; 415/174.4

(58) Field of Classification Search ..... 415/9, 173.1, 415/173.4, 174.4, 196, 197, 220
See application file for complete search history.

(56) References Cited

U.S. PATENT DOCUMENTS 5,160,248 A * 11/1992 Clarke ..... 415/9
6,149,380 A * 11/2000 Kuzniar et al. ..... 415/9
6,290,455 B1 * 9/2001 Hemmelgarn et al. ..... 415/9
7,192,243 B2 * 3/2007 Lawson et al. ..... 415/9
7,255,528 B2 * 8/2007 Stretton ..... 415/9
7,402,022 B2 * 7/2008 Harper et al. ..... 415/9
7,866,939 B2 * 1/2011 Harper et al. ..... 415/9
7,914,251 B2 * 3/2011 Pool et al. ..... 415/9
2005/0074328 A1 * 4/2005 Martindale et al. ..... 415/173.1
2005/0089391 A1 * 4/2005 Stretton ..... 415/9
2005/0271503 A1 * 12/2005 Harper et al. ..... 415/170.1
2007/0297910 A1 * 12/2007 Pool et al. ..... 416/224
2008/0069688 A1 * 3/2008 Harper et al. ..... 415/196

FOREIGN PATENT DOCUMENTS

GB 2 276 672 A 10/1994
GB 2 356 588 A 5/2001
GB 2 435 904 A 9/2007

* cited by examiner

*Primary Examiner* — Nathaniel Wiehe
*Assistant Examiner* — Christopher R Legendre
(74) *Attorney, Agent, or Firm* — Oliff & Berridge, PLC

(57) ABSTRACT

A fan casing for a gas turbine engine has a fan track liner extending only over an upstream part of the fan blades, and the local stiffness and internal shape of the casing are arranged to promote the break-up of a released fan blade while permitting the leading edge region of the blade to pass through the fan track liner and be contained by the fan casing. This arrangement is particularly suitable for fan blades in which the stiffness and compressive strength are significantly higher in the leading edge region than in the remainder of the blade; for example, hollow metal fan blades or composite fan blades having a metal leading edge cap.

6 Claims, 4 Drawing Sheets

FAN CASING FOR A GAS TURBINE ENGINE

BACKGROUND

This invention relates to gas turbine engines, and more particularly to containment arrangements for fan casings of such engines.

Conventionally, the fan blades of a gas turbine engine rotate within an annular layer of abradable material, known as a fan track, within the fan casing. In operation, the fan blades cut a path into this abradable layer, minimising leakage around the blade tips.

The fan casing incorporates a containment system, designed to contain any released blades or debris if a fan blade should fail for any reason. The strength and compliance of the fan casing must be precisely calculated to absorb the energy of the resulting debris. It is therefore essential that the fan track should not interrupt the blade trajectory in a blade-off event, and therefore the fan track must be relatively weak so that any released blade or blade fragment can pass through it essentially unimpeded to the containment system.

Rearward of the fan track, there is conventionally provided an annular ice impact panel. This is typically a glass-reinforced plastic (GRP) moulding, or a tray or panel of some other material. It may also be wrapped with GRP to increase its impact strength. Ice that forms on the fan blades is acted on both by centrifugal and by airflow forces, which respectively cause it to move outwards and rearwards before being shed from the blade.

The geometry of a conventional fan blade is such that the ice is shed from the trailing edge of the blade, and it will strike the ice impact panel rearward of the fan track. The ice will bounce off, or be deflected by, the ice impact panel without damaging the panel.

Swept fan blades have a greater chord length at their central portion than conventional fan blades. Swept fan blades are increasingly favoured in the gas turbine industry as they offer significant advantages in efficiency over conventional blades. Because of their greater chordal length, ice that forms on such a blade, although it follows the same rearward and outward path as on a conventional blade, may reach the radially outer tip of the blade before it reaches the trailing edge. It will therefore be shed from the blade tip and strike the fan track.

However, a conventional fan track is not strong enough to tolerate ice impact, and so conventional arrangements are not suitable for use with swept fan blades. It is not possible simply to strengthen the fan track to accommodate ice impact, because this would disrupt the blade trajectory during a blade-off event, and compromise the operation of the fan casing containment system.

The gas turbine industry has also favoured the development of lighter fan blades in recent years; such blades are typically either of hollow metal or of composite construction. This development has given rise to another problem. Because the blade is lighter, and therefore its resistance to deformation is lower, it is even more difficult to devise a casing arrangement that will resist the passage of ice and yet not interfere with the trajectory of a released fan blade. Furthermore, lightweight swept blades tend to break up, on impact with a fan casing, in a different way from conventional blades, and conventional casing designs are not designed to accommodate this.

In summary, the developments in the gas turbine industry towards, on the one hand, swept fan blades, and on the other, lighter fan blades, have made it increasingly difficult to design a fan casing and containment arrangement that can deliver the three functions required of such an arrangement— namely an abradable fan track, resistance to shed ice and containment of blades or blade fragments.

SUMMARY

It is therefore an objective of this invention to provide a gas turbine engine containment assembly that will substantially overcome the problems described above, and that is particularly suited for use with composite, or other lightweight, fan blades.

Embodiments of the invention will now be described, by way of example, making reference to the accompanying drawings in which:

DETAILED DESCRIPTION OF THE DRAWINGS

FIG. 1 is a schematic half sectional view of a gas turbine engine of known type;

FIG. 2*a* is a schematic side view of a conventional fan blade;

FIG. 2*b* is a schematic side view of a swept fan blade;

DETAILED DESCRIPTION

Figure 1:
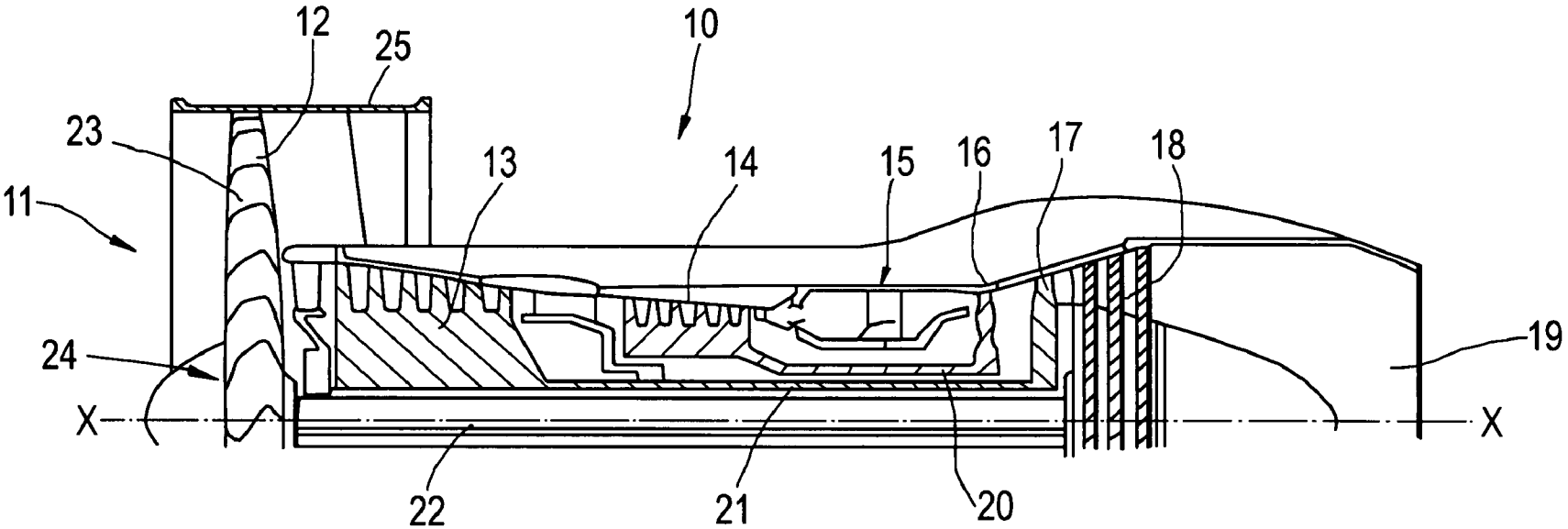

Referring first to FIG. 1, a gas turbine engine 10 comprises, in axial flow series: an intake 11; fan 12; intermediate pressure compressor 13; high pressure compressor 14; combustor 15; high, intermediate and low pressure turbines 16, 17 and 18 respectively; and an exhaust nozzle 19.

Air enters the engine through the intake 11 and is accelerated by the fan 12 to produce two flows of air, the outer of which is exhausted from the engine 10 through a fan duct (not shown) to provide propulsive thrust. The inner flow of air is directed into the intermediate pressure compressor 13 where it is compressed and then directed into the high pressure compressor 14 where further compression takes place.

The compressed air is then mixed with fuel in the combustor 15 and the mixture combusted. The resultant combustion products then expand through the high, intermediate and low pressure turbines 16, 17, 18 respectively before being exhausted through the exhaust nozzle 19 to provide additional propulsive thrust. The high, intermediate and low pressure turbines 16, 17, 18 drive the high and intermediate pressure compressors 14, 13 and the fan 12, respectively, via concentric driveshafts 20, 21, 22.

The fan 12 comprises a circumferential array of fan blades 23 mounted on a fan disc 24. The fan 12 is surrounded by a fan casing 25, which (together with further structure not shown) defines a fan duct. In use, the fan blades 23 rotate around the axis X-X.

Figure 2B:
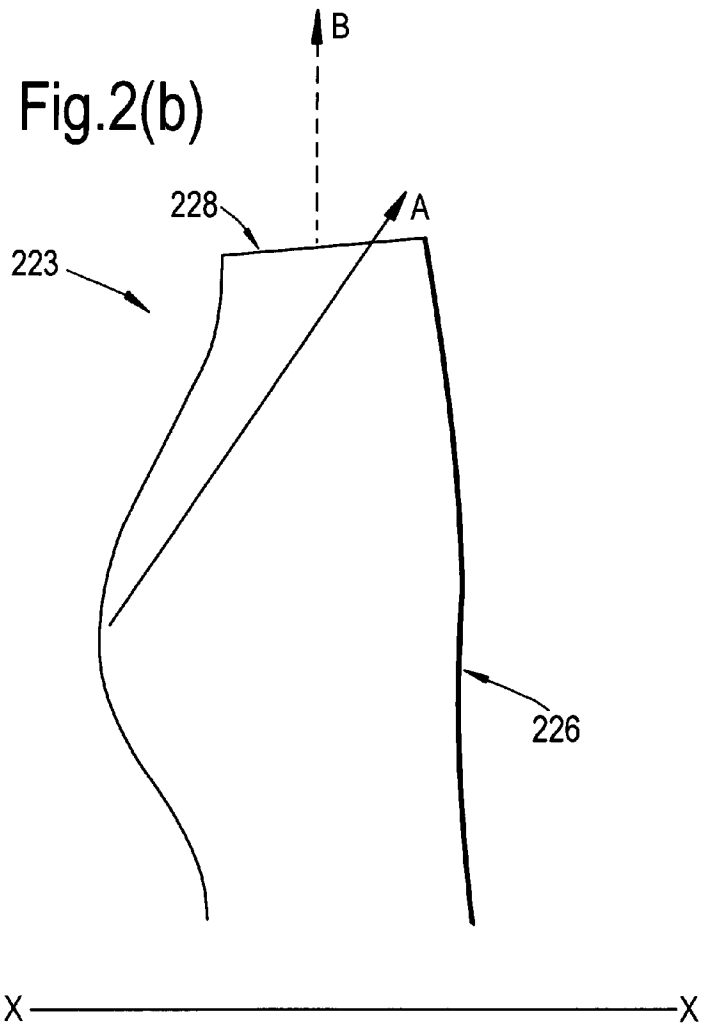
Figure 2A:
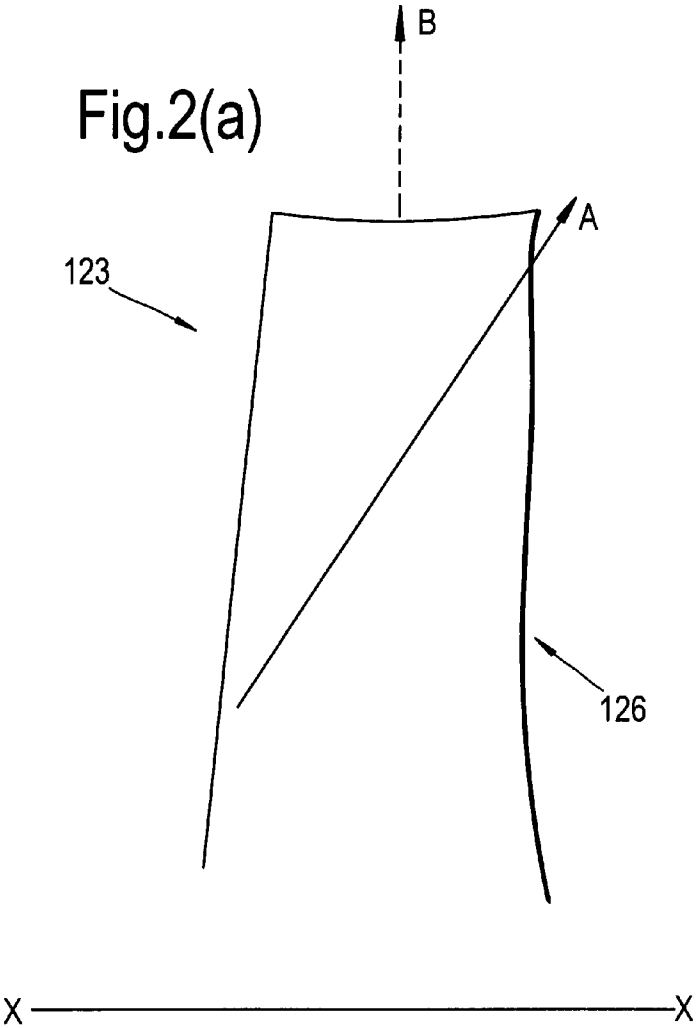

FIG. 2(*a*) shows a conventional fan blade 123. The arrow A shows a notional path followed by a piece of ice across the surface of the blade 123. The ice is released from the trailing edge 126 of the blade 123, and will therefore hit the ice impact panel rearward of the fan track. In a blade-off event, part or all of a fan blade 123 is abruptly released. The trajectory of the released blade is not significantly affected by gas loads, and so it moves essentially in a radially outward direction as shown by the dashed arrow B, to strike the fan track.

FIG. 2(*b*) shows a swept fan blade 223. The arrow A shows a notional path followed by a piece of ice across the surface of the blade 223. This path is essentially the same as the path followed by the ice across the surface of the conventional fan blade 123, in FIG. 2(*a*). Likewise, the trajectory B of a released fan blade or blade fragment is essentially the same as the trajectory B in FIG. 2(*a*). However, it will be seen in FIG. 2(*b*) that the greater chordal dimension of the swept blade 223 will cause the ice to be released at the tip 228 of the blade, rather than at the trailing edge 226. With a conventional fan casing arrangement, as described above, this ice would then strike the fan track rather than the ice impact panel. The problem is that the energy of impact of the ice may be greater than the local energy of impact of a released blade or blade fragment. The fan casing arrangement must therefore have the mutually contradictory properties that it will permit a released fan blade, or blade fragment, to pass through essentially unimpeded to the containment system, and yet will deflect released ice having a higher energy of impact.

Figure 3:
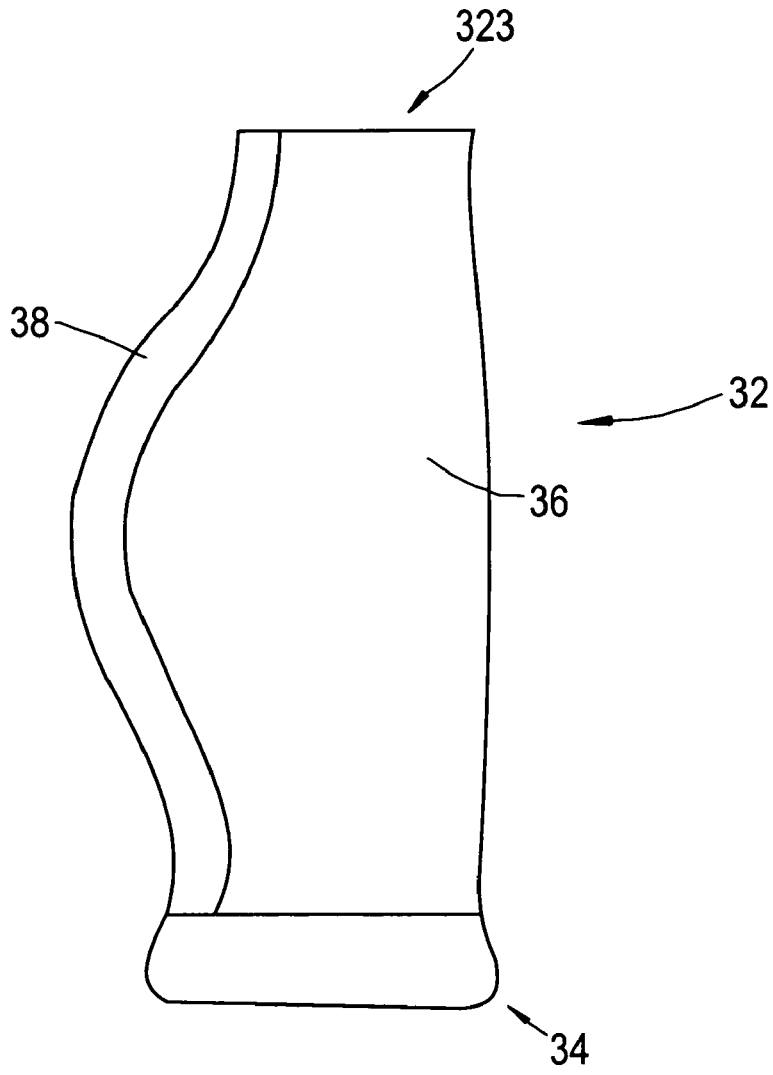
FIG. 3 is a schematic side view of a composite swept fan blade.

In FIG. 3, a composite swept fan blade 323 comprises an aerofoil section 32 and a root section 34. The aerofoil section 32 comprises a body 36, which is formed of composite material, and a leading edge cap 38, which is formed of metal. The leading edge cap 38 provides protection for the body 36 against foreign object damage and erosion in service, which might otherwise lead to debonding and delamination of the composite material.

Figure 4:
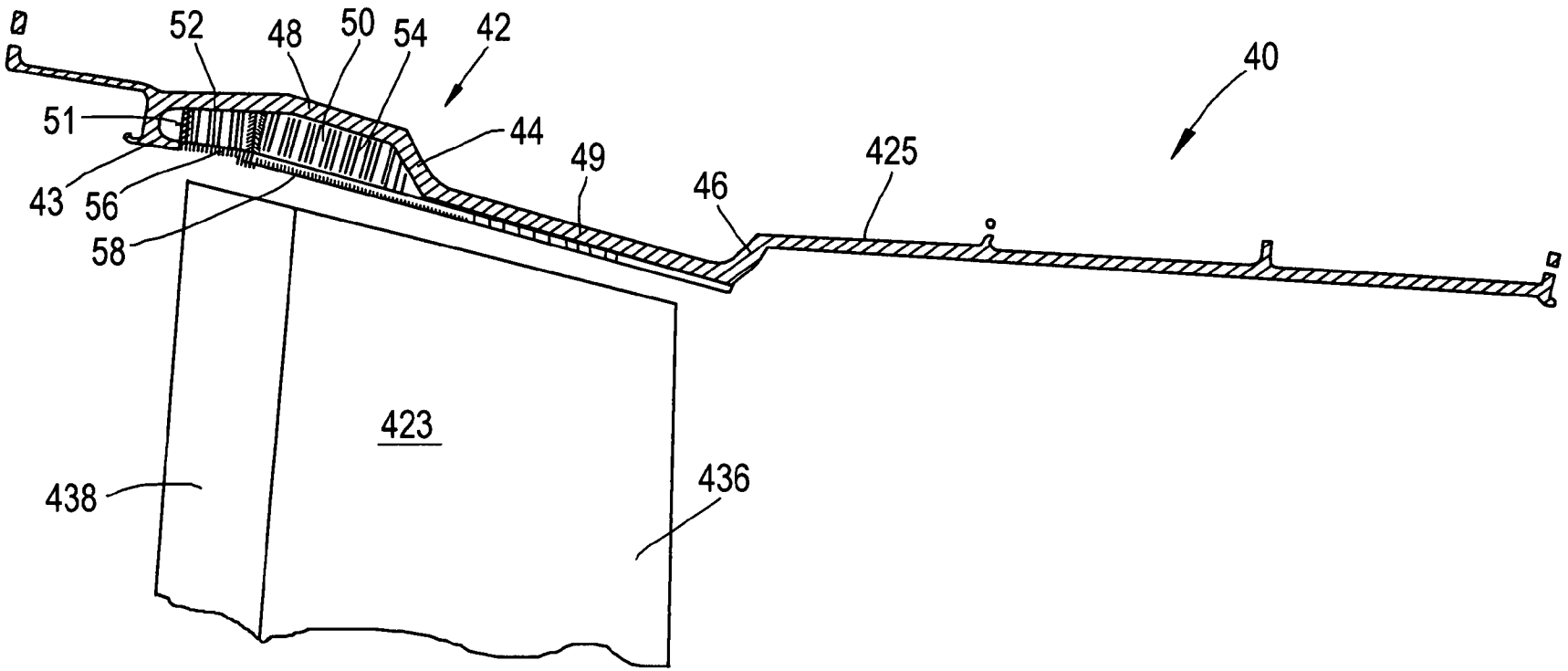
FIG. 4 is a sectional view of a fan casing according to the invention.

FIG. 4 is a section through a fan casing according to the invention. The fan casing 425 extends circumferentially about the engine, and comprises an essentially cylindrical downstream (rearward) part 40 and an essentially frustoconical upstream (forward) part 42. At the forward end of the upstream part 42 is an annular fan case hook 43, the purpose of which will be explained presently. In use, the fan blades 423 of the gas turbine engine rotate within the upstream part 42. The fan blades 423 are composite swept fan blades of the type shown in FIG. 3. The upstream part 42 includes two inclined regions 44, 46, which serve to add stiffness to this part of the fan casing 425 by introducing different radial heights into the casing. At its upstream end, the upstream part 42 defines an annular recess 48.

Mounted in the annular recess 48 is a circumferential array of fan track liner panels 50. Each liner panel 50 comprises a shell 51 containing two regions of honeycomb material 52, 54. A septum layer 56 covers the honeycomb material 52, 54. The liner panels 50 are clipped into place in the recess 48. An abradable coating 58 is applied over the septum layer 56 and extends rearward over the rearward section 49 of the upstream part 42. In use, the fan blades 423 cut a path into the abradable layer 58, minimising leakage around the blade tips.

In the event that a fan blade 42 is released in operation, the blade 423 will impact the upstream part 42 of the fan casing 425.

As the released fan blade 423 contacts the casing, significant compressive load (in the direction of the blade span) builds up, to the point where the strength of the composite material is exceeded. The exception is the relatively stiff leading edge cap, which is better able to resist the compressive forces, survives longer and therefore poses more of a threat to the containment casing. This feature therefore requires a different containment strategy from those employed in known arrangements.

The body 436 of the fan blade 423 will therefore break up on impact into relatively small fragments, which will be deflected by the rearward section 49 without causing damage to it, and will be carried away by the air flow. The construction of this part of the fan casing 425, with only an abradable coating 58 covering the casing itself, will also encourage the breaking up of the fan blade.

The leading edge cap 438, by contrast, is relatively strong and will not readily break up on impact. It will plough through the fan track liner panel 50 (dissipating energy as it does so), strike the fan casing 425 and be deflected forward so as to engage the fan case hook 43. The leading edge cap 438 will therefore be contained within the annular recess 48.

In an alternative embodiment to that shown in FIG. 4, the fan blades 423 are hollow metal swept blades of known type. In this type of blade, the hollow central region of the blade is surrounded by a peripheral solid region around the leading and trailing edges and the tip of the blade, sometimes referred to as a "picture frame". In order to provide suitable protection against impacts and foreign object damage, this solid region is thickest at the leading edge of the blade. It will be appreciated that, in use, this solid leading edge region of the blade will behave in a similar manner to the leading edge cap 438 of the composite blade shown in FIG. 4, because (like the leading edge cap 438) it is stiffer and has greater compressive strength than the hollow, central region of the blade. Therefore, the behaviour of such a blade on impact with a fan casing 425 according to the invention will be similar to the behaviour of the composite blade 423 described above—the hollow central region of the blade will break up relatively easily, whereas the solid leading edge region will plough through the fan track liner panel 50, strike the fan casing 425 and be deflected forward so as to engage the fan case hook 43. In this case, the solid leading edge region will be contained within the annular recess 48.

The invention is therefore equally suited to composite and to hollow metal blades, in that the behaviour of the leading edge is specifically catered for in both cases.

It is envisaged that a plurality of discrete fan track liner panels 50 will be arranged around the circumference of the annular recess 48, secured in place by clips of other suitable fixings. This will permit simple repair or replacement of damaged panels 50 in service, without the need for costly and time-consuming disassembly.

The invention has been described with reference to a composite fan blade. However, it is envisaged that the invention would be equally applicable for use with any design of fan blade in which the leading edge is significantly stiffer and stronger than the other areas of the blade. This includes (but is not limited to) blades made from metal, from foam or from other structural materials, in which the properties of the leading edge are different from those in the body of the blade, as well as blades made from composite materials (for example carbon- or glass-fibre) in which a separate leading edge cap is provided to enhance the protection of the blade against such threats as bird strike, hailstones and erosion.

The invention therefore provides a containment arrangement more precisely tailored to the manner in which the fan blades deform, and whose design is optimised by providing a fan track liner only in the region where it is needed.

The different radial heights inherent in the casing design, introduced by the inclined regions 44, 46, add stiffness to the casing. This may reduce or remove the need for external ribs, thus permitting the forging size to be smaller than for a conventional casing with equivalent properties.

A further advantage of the invention is that it permits holes to be drilled through the inclined regions of the casing (44 and 46 in FIG. 4). These holes could be used to retain liner segments, or for other purposes. It is not desirable to drill holes in a conventional fan casing, because the structure around the holes is put into tension when a released fan blade impacts the casing, and so the material would be prone to cracking. By contrast, in a fan casing according to the invention, when a released fan blade impacts on the region 49 of the fan casing it will tend to put the regions 44 and 46 into compression, and so the likelihood of cracking around holes in these regions is reduced.

The invention claimed is:

1. A fan blade containment assembly for a gas turbine engine, the engine including a plurality of fan blades which in use rotate about an axis of the engine, the blade containment assembly comprising:

an annular casing radially outward of the fan blades and extending axially both upstream and downstream of the fan blades, the casing including a radially-outwardly extending annular recess in which in use a fan blade may be released in a generally radially outward direction and strike the casing; and a fan track liner located in the annular recess which can in use be penetrated by a part of a released fan blade, wherein the annular recess extends only over an upstream part of the fan blades.

2. The fan blade containment assembly as claimed in claim 1, wherein the annular recess extends only over the leading edge region of the fan blades.

3. The fan blade containment assembly as claimed in claim 1, wherein the radially inner surface of the assembly comprises an abradable layer.

4. The fan blade containment assembly as claimed in claim 3, wherein the abradable layer extends over the whole axial length of the fan blades.

5. The fan blade containment assembly as claimed in claim 4, wherein the abradable layer downstream of the fan track liner is attached directly to the radially inner surface of the casing.

6. The fan blade containment assembly as claimed in claim 1, wherein the fan track liner comprises a plurality of discrete liner panels.

* * * * *